US010569993B2

(12) United States Patent
Watson et al.

(10) Patent No.: US 10,569,993 B2
(45) Date of Patent: Feb. 25, 2020

(54) SAFETY BRAKE ACTUATION MECHANISM FOR A HOISTED STRUCTURE

(71) Applicant: Otis Elevator Company, Farmington, CT (US)

(72) Inventors: Benjamin J. Watson, Collinsville, CT (US); Erik Khzouz, Plainville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 275 days.

(21) Appl. No.: 15/473,062

(22) Filed: Mar. 29, 2017

(65) Prior Publication Data

US 2018/0282124 A1 Oct. 4, 2018

(51) Int. Cl.
*B66B 5/18* (2006.01)
*B66B 9/00* (2006.01)

(52) U.S. Cl.
CPC . *B66B 5/18* (2013.01); *B66B 9/00* (2013.01)

(58) Field of Classification Search
CPC ..... B66B 5/18; B66B 9/00
See application file for complete search history.

(56) References Cited

U.S. PATENT DOCUMENTS 900,473 A 10/1908 Bohlen
1,167,702 A * 1/1916 Leal ..... B66B 5/26 187/366
1,219,918 A * 3/1917 Coates ..... B66B 5/26 187/366
1,570,813 A * 1/1926 Wilson ..... B66B 5/26 187/366
1,626,583 A * 4/1927 Ordog ..... B66B 5/26 187/366
5,096,020 A * 3/1992 Korhonen ..... B66B 5/22 187/359

(Continued)

FOREIGN PATENT DOCUMENTS

CN 102874669 A 1/2013
EP 1205418 A1 5/2002

(Continued)

OTHER PUBLICATIONS

Search Report regarding related EP App. No. 18164227.3; dated Sep. 3, 2018; 8 pgs.

*Primary Examiner* — Michael A Riegelman
(74) *Attorney, Agent, or Firm* — Cantor Colburn LLP

(57) ABSTRACT

A safety brake actuation mechanism for a hoisted structure includes a housing operatively coupled to the hoisted structure. Also included is a first brake member coupled to the housing, the first brake member moveable between a braking position and a non-braking position. Further included is a retaining assembly moveable between a first position and a second position and engageable with the first brake member, the retaining assembly retaining the first brake member in the non-braking position in the first position and permitting the first brake member to move to the braking position in the second position. Yet further included is an electric actuator operatively coupled to the retaining assembly and biasing the retaining assembly to the first position in a powered state of the electric actuator, the retaining assembly movable to the second position in a non-powered state of the electric actuator.

12 Claims, 4 Drawing Sheets

(56) References Cited

U.S. PATENT DOCUMENTS 5,209,325 A * 5/1993 Gines ..... B60T 7/126 187/375
6,425,462 B1 * 7/2002 Tran ..... B66B 5/18 187/367
7,374,021 B2 * 5/2008 Marti ..... B66B 5/18 187/288
7,398,863 B2 * 7/2008 Liebetrau ..... B66B 7/046 187/367
7,575,099 B2 * 8/2009 Oh ..... B66B 5/06 187/247
7,909,142 B2 * 3/2011 Noel ..... F16D 59/02 187/373
8,186,483 B2 * 5/2012 Sirigu ..... B66B 5/22 187/288
8,573,365 B2 11/2013 Ito
9,120,643 B2 * 9/2015 Meierhans ..... B66B 5/20
9,708,159 B2 * 7/2017 Rieser ..... B66B 5/20
2004/0262091 A1 * 12/2004 Ito ..... B66B 5/185 187/372
2006/0090969 A1 * 5/2006 Eckenstein ..... B66B 5/185 188/65.1
2007/0007083 A1 * 1/2007 Husmann ..... B66B 5/20 187/366
2012/0152663 A1 * 6/2012 Legeret ..... B66B 5/20 187/404
2013/0081908 A1 * 4/2013 Meierhans ..... B66B 5/18 187/359
2013/0248298 A1 * 9/2013 Osmanbasic ..... B66B 5/20 187/359
2014/0008157 A1 * 1/2014 Terry ..... B66B 5/18 187/359
2015/0259175 A1 * 9/2015 West ..... B66B 5/18 187/359
2016/0200549 A1 * 7/2016 Billard ..... B66B 5/22 188/65.1
2017/0001835 A1 * 1/2017 Hu ..... B66B 5/18
2018/0222718 A1 * 8/2018 Khzouz ..... B66B 5/18
2018/0282124 A1 * 10/2018 Watson ..... B66B 5/18
2019/0062112 A1 * 2/2019 Gorzalczynski ..... B66B 5/18

FOREIGN PATENT DOCUMENTS

EP 2837592 A1 2/2015
EP 3112306 A1 1/2017
FR 2816300 A1 5/2002

* cited by examiner

SAFETY BRAKE ACTUATION MECHANISM FOR A HOISTED STRUCTURE

BACKGROUND

The embodiments herein relate to braking systems and, more particularly, to a brake actuation mechanism for braking systems, such as those employed to assist in braking a hoisted structure.

Hoisting systems, such as elevator systems and crane systems, for example, often include a hoisted structure (e.g., elevator car), a counterweight, and a tension member (e.g., rope, belt, cable, etc.) that connects the hoisted structure and the counterweight. During operation of such systems, a safety braking system is configured to assist in braking the hoisted structure relative to a guide member, such as a guide rail, in the event the hoisted structure exceeds a predetermined velocity or acceleration.

Prior attempts to actuate a braking device typically require a mechanism that includes a governor, a governor rope, a tension device and a safety actuation module. The safety actuation module comprises lift rods and linkages to actuate the safeties, also referred to as a braking device. Reducing, simplifying or eliminating components of this mechanism, while providing a reliable and stable braking of the hoisted structure, would prove advantageous.

BRIEF SUMMARY

According to one aspect of the disclosure, a safety brake actuation mechanism for a hoisted structure includes a housing operatively coupled to the hoisted structure. Also included is a first brake member coupled to the housing and having a brake surface for frictionally engaging a first surface of a guide rail, the first brake member moveable between a braking position and a non-braking position. Further included is a retaining assembly moveable between a first position and a second position and engageable with the first brake member, the retaining assembly retaining the first brake member in the non-braking position in the first position and permitting the first brake member to move to the braking position in the second position. Yet further included is an electric actuator operatively coupled to the retaining assembly and biasing the retaining assembly to the first position in a powered state of the electric actuator, the retaining assembly movable to the second position in a non-powered state of the electric actuator.

According to another aspect of the disclosure, a safety brake actuation mechanism for a hoisted structure includes a housing operatively coupled to the hoisted structure. Also included is a cam coupled to the housing and having a brake surface for frictionally engaging a surface of a guide rail, the cam moveable between a braking position and a non-braking position. Further included is a retaining assembly moveable between a first position and a second position and engageable with the cam, the cam in the non-braking position when the retaining assembly is in the first position, the retaining assembly engageable with the cam to bias the cam to the braking position upon movement to the second position. Yet further included is an electric actuator operatively coupled to the retaining assembly and biasing the retaining assembly to the first position in a powered state of the electric actuator, the retaining assembly movable to the second position in a non-powered state of the electric actuator.

According to yet another aspect of the disclosure, an elevator system includes an elevator car moveable within an elevator passage. Also included is a guide rail extending along a wall of the elevator passage. Further included is a housing operatively coupled to the elevator car. Yet further included is a first brake member coupled to the housing and having a first brake surface for frictionally engaging a first surface of the guide rail. Also included is a second brake member coupled to the housing and having a second brake surface for frictionally engaging a second surface of the guide rail, the second surface an opposing surface relative to the first surface, the first and second brake members moveable between a braking position and a non-braking position. Further included is a linkage moveable between a first position and a second position and engageable with the first brake member and the second brake member, the linkage retaining the first and second brake members in the non-braking position in the first position and permitting the first brake member to move to the braking position in the second position. Yet further included is a solenoid operatively coupled to the linkage and biasing the linkage to the first position in a powered state of the solenoid, the linkage movable to the second position in a non-powered state of the solenoid. Also included is a spring operatively coupled to the housing, the spring biasing the first brake member and the second brake member toward the braking position, the solenoid exerting a force on the linkage in the powered state that overcomes a biasing force exerted by the spring on the first brake member and the second brake member.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
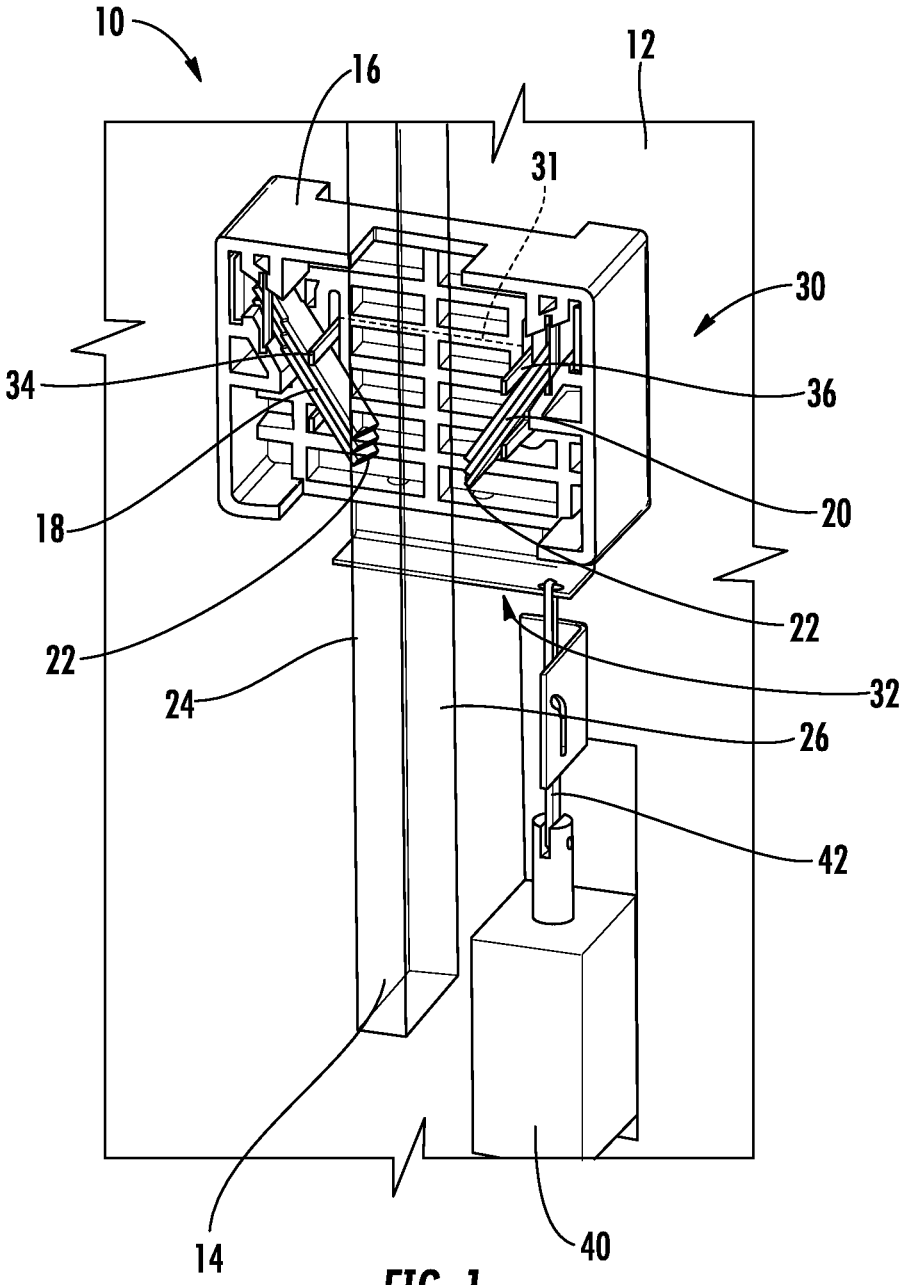
FIG. 1 is a perspective view of a safety brake actuation mechanism in a non-braking position according to an aspect of the disclosure.
Figure 2:
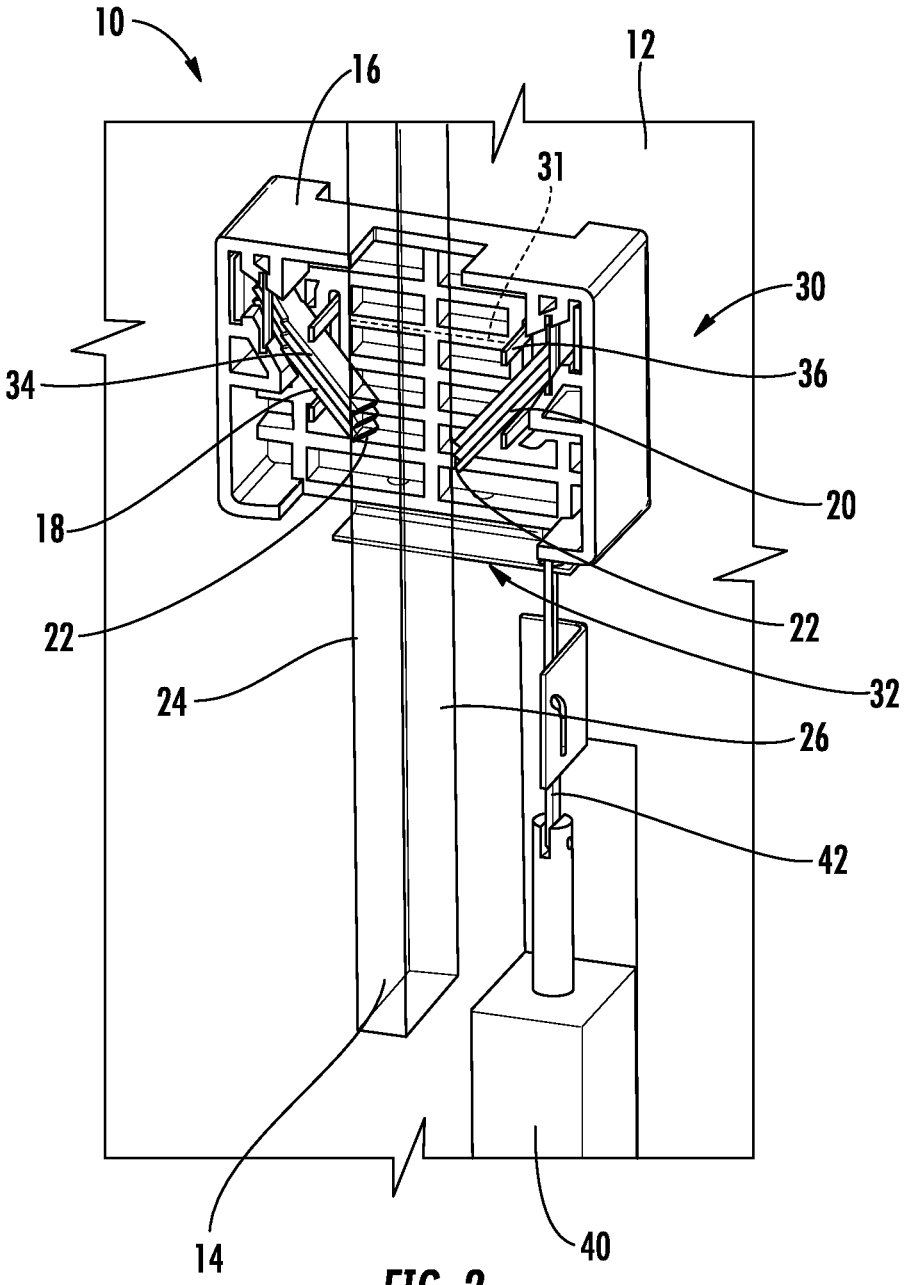
FIG. 2 is a perspective view of the safety brake actuation mechanism of FIG. 1 in a braking position.

FIGS. 1 and 2 illustrate a hoisted structure braking system 10. The embodiments described herein relate to an overall braking system that is operable to assist in braking (e.g., slowing or stopping movement) of a hoisted structure relative to a guide member, as will be described in detail below. In particular, a braking actuation assembly that lifts a safety configured for braking a hoisted structure is described herein. The braking system 10 can be used with various types of hoisted structures and various types of guide members, and the configuration and relative orientation of the hoisted structure and the guide member may vary. In one embodiment, the hoisted structure comprises an elevator car 12 moveable within passage hoistway.

The guide member, referred to herein as a guide rail 14, is connected to a sidewall of the elevator car passage and is configured to guide the hoisted structure, typically in a vertical manner. The guide rail 14 may be formed of numerous suitable materials, typically a durable metal, such as steel, for example.

The braking system 10 includes a housing 16 that is operatively coupled to the elevator car 12 in a location proximate the guide rail 14. The housing 16 is directly or indirectly connected to the elevator car 12 in a manner that allows the housing 16 to move vertically to an extent that accommodates lifting of a wedge of a safety 21. At least one brake member, referred to as a first brake member 18 is coupled to the housing 16. As shown, a second brake member 20 is included in some embodiments and is similarly coupled to the housing 16. The brake members 18, 20 extend from the housing 16 inwardly toward the guide rail 14 and may be any suitable shape. In some embodiments, the brake members 18, 20 are each at least one rectangular bar and may each be a stacked arrangement of rectangular bars, as illustrated. Irrespective of the precise shape, the brake members 18, 20 each include a respective brake surface 22 at an end thereof. The brake surface 22 may be a brake pad or a similar structure suitable for repeatable braking engagement with the guide rail 14. In particular, the brake surface 22 of the first brake member 18 is configured to engage a first surface 24 of the guide rail 14 and the brake surface 22 of the second brake member 20 is configured to engage a second surface 26 of the guide rail 14. The first and second surfaces 24, 26 of the guide rail 14 are on opposite sides of the guide rail 14 in some embodiments. In one embodiment, the brake surface 22 may be integral with each of the brake members 18, 20. In one embodiment, a one movable brake member and one fixed brake member may be employed. In one embodiment, greater than two brake members 18, 20 may be used.

The brake members 18, 20 are positioned on the housing 16 in a manner that disposes the brake members 18, 20 in proximity with the guide rail 14. Specifically, the brake surfaces 22 are disposed in close proximity to the guide rail 14 and are operable to frictionally engage the guide rail 14. The brake members 18, 20 are moveable between a non-braking position (FIG. 1) to a braking position (FIG. 2). The non-braking position is a position that the braking system 10 is disposed in during normal operation of the elevator car 12. In particular, the brake members 18, 20 are not in contact with the guide rail 14 while in the non-braking position, and thus the brake surfaces 22 do not frictionally engage the guide rail 14. Subsequent to movement of the brake members 18, 20, the brake surfaces 22 are in contact with the guide rail 14, thereby frictionally engaging the guide rail 14.

An actuation mechanism 30 includes a retaining assembly 32 comprising a linkage for retaining the brake members 18, 20 in the non-braking position. As shown, the brake members 18, 20 are oriented at a non-parallel angle relative to a longitudinal axis of the guide rail 14, as well as relative to the first and second surfaces 24, 26 of the guide rail 14. In some embodiments, the brake members 18, 20 are oriented at an angle of between 0 and 90 degrees relative to the surfaces 24, 26 of the guide rail 14.

As described above, the retaining assembly 32 retains the brake members 18, 20 in the non-braking position when the retaining assembly 32 is in a first position (FIG. 1). In the illustrated embodiment, the retaining assembly 32 includes a first pair of teeth 34 for retaining the first brake member 18 in the non-braking position and a second pair of teeth 36 for retaining the second brake member 20 in the non-braking position. It is contemplated that a single or multiple teeth, a hook, a latch, or the like may be employed to contact the brake members 18, 20. Furthermore, in some embodiments the brake members 18, 20 are connected and only one of the brake members 18 or 20 is in contact with the retaining assembly 32.

The retaining assembly 32 is operatively coupled to an electric actuator 40 that exerts a force on the retaining assembly 32 when the electric actuator 40 is in a powered state (e.g., energized state), as shown in FIG. 1. In some embodiments, the electric actuator 40 is a solenoid. The electric actuator 40 may be directly coupled to the retaining assembly 32 or may be indirectly coupled thereto with a rigid rod 42 or the like. In the powered state, the electric actuator 40 exerts a force on the retaining assembly 32 that biases the retaining assembly 32 into the first position, thereby placing the brake members 18, 20 in the non-braking position (FIG. 1).

Figure 4:
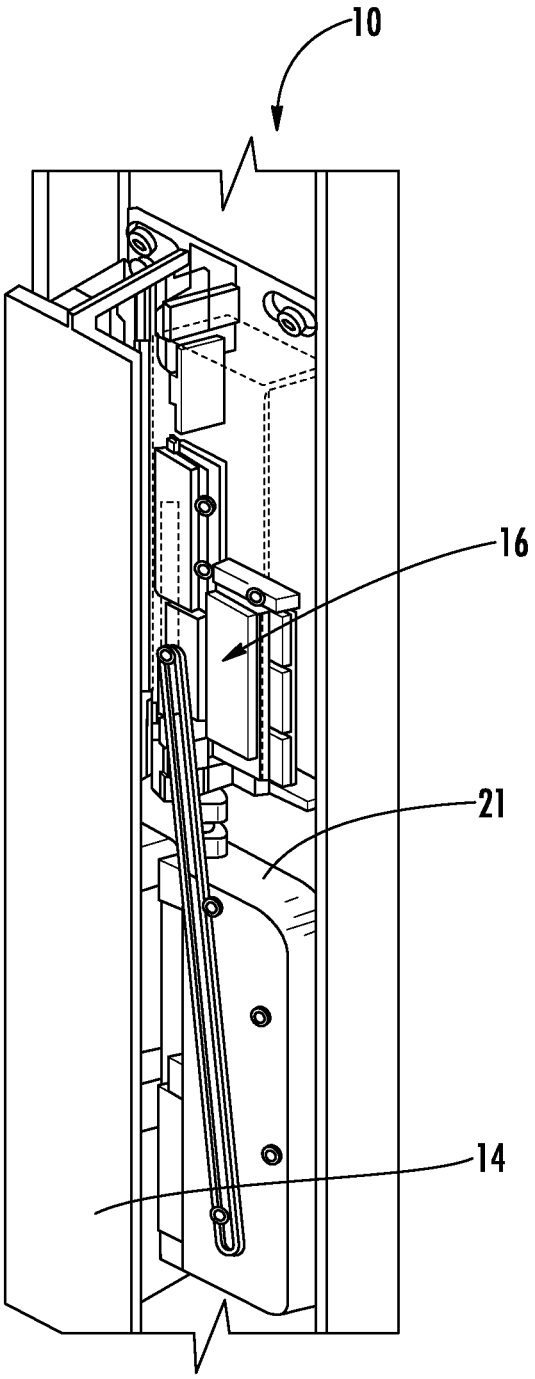
FIG. 4 is a perspective view of a safety that is actuated by the safety brake actuation mechanism.

In a non-powered state of the electric actuator 40, the force exerted on the retaining assembly 32 is removed and the retaining teeth 34, 36 are displaced during movement of the retaining assembly 32 to the second position, thereby allowing movement of the brake members 18, 20 (FIG. 2). In the second position, a biasing member, such as a spring 31 that is coupled to the housing 16 drives the brake members 18, 20 into contact with the guide rail 14 during movement from the non-braking position to the braking position. The biasing member is a pneumatic or hydraulic device is other embodiments. In the braking position, the frictional force between the brake surfaces 22 of the brake members, 18, 20 and surfaces 24, 26 of the guide rail 14 triggers lifting of a safety wedge that is part of a safety 21 to stop movement of the elevator car 12 relative to the guide rail 14 (FIG. 4). In the first position of the retaining assembly 32, during the powered state of the electric actuator 40, the retaining force exerted on the brake members 18, 20 is sufficient to overcome the biasing force of the spring, but once the retaining assembly 32 is shifted to the second position, the spring force is free to initiate engagement between the brake members 18, 20 and the guide rail 14.

In some embodiments, two solenoids are included. Each solenoid is operatively coupled to a respective biasing member, with each biasing member biasing the retaining teeth.

Figure 3:
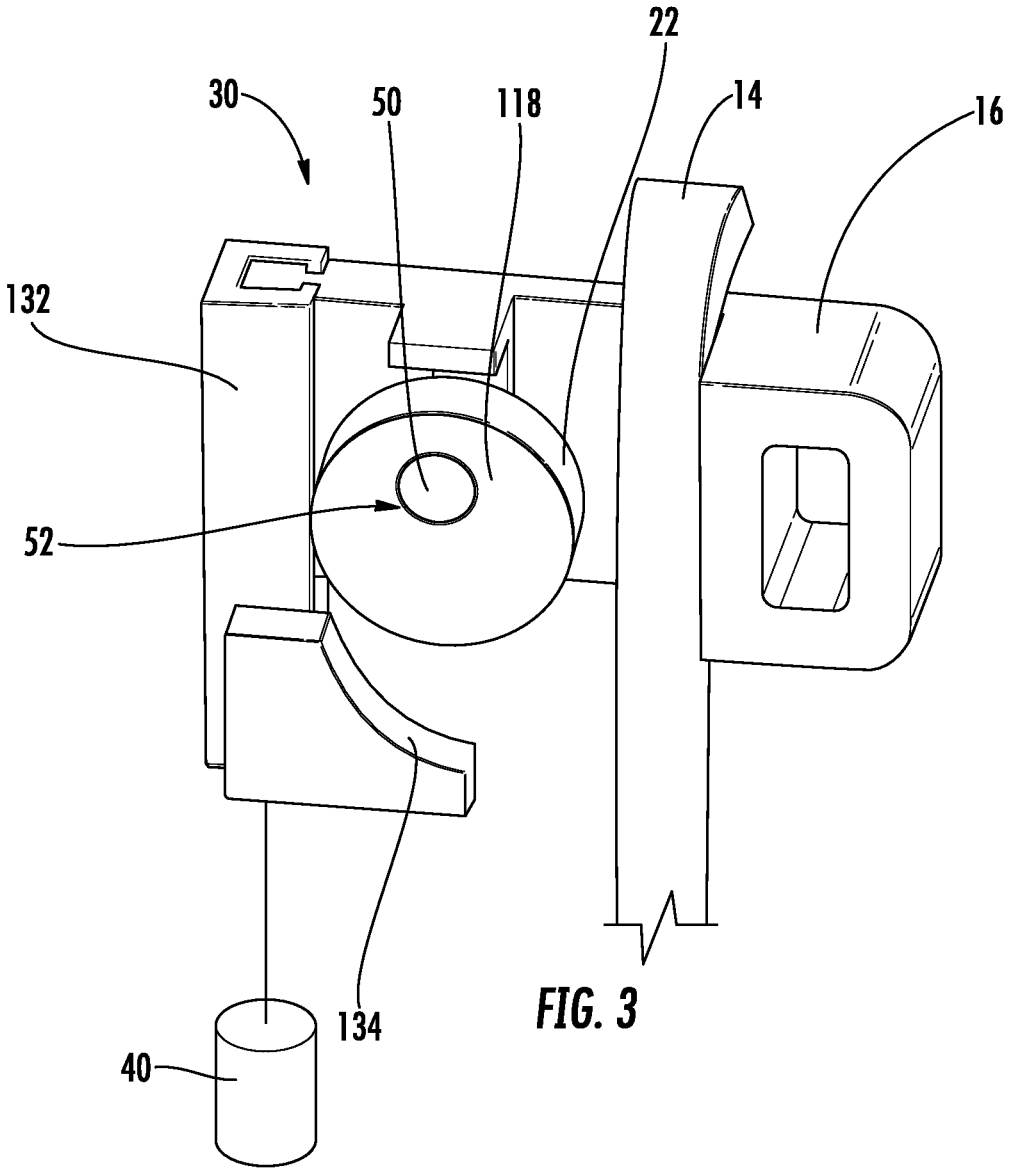
FIG. 3 is a perspective view of the safety brake actuation mechanism according to another aspect of the disclosure.

Referring now to FIG. 3, the safety brake actuation mechanism 30 is illustrated according to another embodiment. In the illustrated embodiment, a cam 118 is the brake member that is coupled to the housing 16 in a rotatable manner via a pin 50 extending through an aperture 52 defined by the cam 118. The cam 118 includes an outer surface that is the brake surface 22 for engaging a surface of the guide rail 14. A retaining assembly 132 includes a curved portion 134 that is not in contact with the cam 118 in the first position (FIG. 3). Upon movement to the second position of the retaining assembly 132, the curved portion 134 engages the cam 118 and biases the cam 118 toward the guide rail 14 until the brake surface 22 engages the guide rail 14 for frictional engagement. In some embodiments, an additional cam is disposed on the opposing side of the guide rail 14, relative to cam 118 to form a symmetric arrangement.

As with the embodiments of FIGS. 1 and 2, the electric actuator 40, such as a solenoid maintains the retaining assembly 132 in the first position during a powered state of the electric actuator 40. Upon switching to the non-powered state of the electric actuator 40, the retaining assembly 132 is biased upwardly by a spring or the like to initiate the above-described engagement of the curved portion 134 with the cam 118.

In operation, for each of the embodiments described herein, an electronic sensor and/or control system (not illustrated) is configured to monitor various parameters and conditions of the hoisted structure and to compare the monitored parameters and conditions to at least one predetermined condition. In one embodiment, the predetermined condition comprises velocity and/or acceleration of the hoisted structure. In the event that the monitored condition (e.g., over-speed, over-acceleration, etc.) exceeds the predetermined condition, the brake member(s) is actuated upon de-energization of the electric actuator 40 to facilitate mechanical engagement of the brake member(s) and the guide rail 14. Additionally, if system power is lost, the electric actuator 40 may enter the non-powered state and actuation of the brake member(s) is initiated.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., a processor, apparatus or system) to perform one or more methodological acts as described herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

What is claimed is:

1. A safety brake actuation mechanism for a hoisted structure comprising:

a housing operatively coupled to the hoisted structure;

a first brake member coupled to the housing and having a brake surface for frictionally engaging a first surface of a guide rail, the first brake member moveable between a braking position and a non-braking position;

a retaining assembly moveable between a first position and a second position and engageable with the first brake member, the retaining assembly retaining the first brake member in the non-braking position in the first position and permitting the first brake member to move to the braking position in the second position; and an electric actuator operatively coupled to the retaining assembly and biasing the retaining assembly to the first position in a powered state of the electric actuator, the retaining assembly movable to the second position in a non-powered state of the electric actuator;

and further comprising a second brake member coupled to the housing and having a brake surface for frictionally engaging a second surface of the guide rail, the second surface an opposing surface relative to the first surface, the second brake member retained by the retaining assembly and moveable between the braking position and the non-braking position, wherein the first brake member and the second brake member are angled at less than 90 degrees relative to a longitudinal axis of the guide rail.

2. The safety brake actuation mechanism of claim 1, wherein the first brake member comprises a rectangular bar.

3. The safety brake actuation mechanism of claim 1, wherein the retaining assembly comprises a pair of teeth engaged with the first brake member in the non-braking position.

4. The safety brake actuation mechanism of claim 1, wherein the retaining assembly is comprises a linkage.

5. The safety brake actuation mechanism of claim 1, further comprising a biasing member operatively coupled to the housing, the biasing member biasing the first brake member toward the braking position, the electric actuator exerting a force on the retaining assembly in the powered state that overcomes a biasing force exerted by the biasing member on the first brake member.

6. The safety brake actuation mechanism of claim 5, wherein the biasing member comprises a spring.

7. The safety brake actuation mechanism of claim 1, wherein the electric actuator is a solenoid.

8. The safety brake actuation mechanism of claim 1, wherein the electric actuator is coupled to the retaining assembly with a rigid rod.

9. A safety brake actuation mechanism for a hoisted structure comprising:

a housing operatively coupled to the hoisted structure;

a first brake member coupled to the housing and having a brake surface for frictionally engaging a first surface of a guide rail, the first brake member moveable between a braking position and a non-braking position;

a retaining assembly moveable between a first position and a second position and engageable with the first brake member, the retaining assembly retaining the first brake member in the non-braking position in the first position and permitting the first brake member to move to the braking position in the second position; and an electric actuator operatively coupled to the retaining assembly and biasing the retaining assembly to the first position in a powered state of the electric actuator, the retaining assembly movable to the second position in a non-powered state of the electric actuator;

wherein the first brake member comprises a plurality of rectangular bars in a stacked arrangement.

10. An elevator system comprising:

an elevator car moveable within an elevator passage;

a guide rail extending along a wall of the elevator passage;

a housing operatively coupled to the elevator car;

a first brake member coupled to the housing and having a first brake surface for frictionally engaging a first surface of the guide rail;

a second brake member coupled to the housing and having a second brake surface for frictionally engaging a second surface of the guide rail, the second surface an opposing surface relative to the first surface, the first and second brake members moveable between a braking position and a non-braking position;

a linkage moveable between a first position and a second position and engageable with the first brake member and the second brake member, the linkage retaining the first and second brake members in the non-braking position in the first position and permitting the first brake member to move to the braking position in the second position;

a solenoid operatively coupled to the linkage and biasing the linkage to the first position in a powered state of the solenoid, the linkage movable to the second position in a non-powered state of the solenoid; and a spring operatively coupled to the housing, the spring biasing the first brake member and the second brake member toward the braking position, the solenoid exerting a force on the linkage in the powered state that overcomes a biasing force exerted by the spring on the first brake member and the second brake member.

11. The elevator system of claim 10, wherein the first brake member and the second brake member each comprise at least one rectangular bar.

12. The elevator system of claim 10, wherein the linkage comprises a first pair of teeth engaged with the first brake member and a second pair of teeth engaged with the second brake member in the non-braking position.

* * * * *